US007089770B2

(12) United States Patent
Ramsauer et al.

(10) Patent No.: US 7,089,770 B2
(45) Date of Patent: Aug. 15, 2006

(54) ELECTRICALLY BLOCKABLE SWIVELING LEVER CONTROL

(75) Inventors: Dieter Ramsauer, Schwelm (DE); Volkhard Petersen, Remscheid (DE)

(73) Assignee: DIRAK Dieter Ramsauer Konstruktionselemente GmbH & Co. KG, Ennepetal (DE)

( * ) Notice: Subject to any disclaimer, the term of this patent is extended or adjusted under 35 U.S.C. 154(b) by 646 days.

(21) Appl. No.: 10/239,611

(22) PCT Filed: Feb. 10, 2001

(86) PCT No.: PCT/EP01/01486

§ 371 (c)(1),
(2), (4) Date: Jan. 26, 2003

(87) PCT Pub. No.: WO01/77465

PCT Pub. Date: Oct. 18, 2001

(65) Prior Publication Data

US 2003/0141724 A1 Jul. 31, 2003

(51) Int. Cl.
*E05B 13/10* (2006.01)

(52) U.S. Cl. ..... 70/208; 70/210; 70/278.1; 70/278.7; 292/DIG. 31

(58) Field of Classification Search ..... 70/208, 70/209, 210, 224, 275, 278.1, 278.2, 278.3, 70/278.7; 292/DIG. 31
See application file for complete search history.

(56) References Cited

U.S. PATENT DOCUMENTS

| | | | | |
|---|---|---|---|---|
| 3,745,796 | A | 7/1973 | Fleming | 70/81 |
| 5,409,272 | A | 4/1995 | McCormack | 292/66 |
| 5,826,450 | A | 10/1998 | Lerchner et al. | 70/277 |
| 5,893,282 | A | 4/1999 | Runge et al. | 70/208 |
| 5,970,757 | A * | 10/1999 | Ramsauer | 70/208 |
| 6,053,018 | A * | 4/2000 | Ramsauer | 70/208 |
| 6,318,134 | B1 * | 11/2001 | Mossberg et al. | 70/63 |
| 6,370,928 | B1 * | 4/2002 | Chies et al. | 70/278.3 |
| 6,490,896 | B1 * | 12/2002 | Segawa | 70/208 |
| 6,496,101 | B1 * | 12/2002 | Stillwagon | 340/5.61 |
| 6,564,764 | B1 * | 5/2003 | Karbstein et al. | 123/90.48 |

FOREIGN PATENT DOCUMENTS

| | | |
|---|---|---|
| CA | 2206286 | 11/1998 |
| DE | 90 12 372 | 1/1992 |
| DE | 42 12 291 | 10/1993 |
| DE | 298 06 974 | 8/1998 |
| DE | 201 02 047 | 5/2001 |
| EP | 0 824 624 | 2/1998 |
| EP | 0 787 874 | 8/1998 |
| EP | 0 976 897 | 2/2000 |
| WO | WO 97/40248 | 10/1997 |

* cited by examiner

*Primary Examiner*—John B. Walsh
(74) *Attorney, Agent, or Firm*—Reed Smith LLP

(57) ABSTRACT

The description relates to a closure for mounting in an opening in a thin wall, such as a sheet metal cabinet door, which comprises a housing and which has, at one end, a bearing support for an actuation lever and, at its other end, a lock device for the actuation lever and a fastening device such as a clamping clip therebetween. The housing has a partially spherical bearing surface with a cylindrical bore hole proceeding from it, wherein a partial ball with a first bearing for a closure drive shaft extending through the cylindrical bore hole and with a second bearing for the actuation lever is arranged in the cylindrical bore hole, and the two bearings enable a rotation of the partial ball in relation to the housing and a swiveling of the actuation lever in relation to the partial ball around an axis vertical to the closure drive shaft and to the extension of the lever.

17 Claims, 3 Drawing Sheets

ELECTRICALLY BLOCKABLE SWIVELING LEVER CONTROL

CROSS-REFERENCE TO RELATED APPLICATIONS

This application claims priority of PCT Application Ser. No. PCT/EP01/01486, filed Feb. 10, 2001 and German Application No. 200 06 373.1, filed Apr. 6, 2000, the complete disclosures of which are hereby incorporated by reference.

BACKGROUND OF THE INVENTION a) Field of the Invention

The invention is directed to an electrically lockable swivel lever actuating mechanism comprising a dish which can be placed on a door leaf or the like and in which an actuation lever for a closure, such as a sash closure or bar closure, is mounted in such a way that it can be moved out of a position in which it is swiveled out of the dish and in which it enables actuation of the closure into a position in which it is swiveled into the dish and in which it does not allow actuation of the closure and in which it can be locked by an electromechanical lock device.

b) Description of the Related Art

A swivel lever actuating mechanism of the type mentioned above is already known, e.g., from EP 0 824 624 B1. The known swivel lever actuating mechanism requires a special arrangement on the door frame for proper operation. This is uneconomical for many applications.

OBJECT AND SUMMARY OF THE INVENTION

It is the primary object of the invention to modify the electrically lockable swivel lever actuating mechanism of the type mentioned above in such a way that it is constructed in a simple manner and, in particular, requires no special devices that are constructed on the door frame or the like instead of on the door leaf or the like.

In particular, it should be possible to use the arrangement in essentially conventional swivel lever closures.

Another object consists in dispensing with the previously used keys for a cylinder lock or the like which are also prior art.

The object is met in that the electromechanical lock device is a modular unit or constructional unit which can be inserted or integrated in the dish and a pin or projection can be moved out or swiveled out from the constructional unit by means of an electric control signal for locking the actuation lever.

As a result of these features, the swivel lever actuating mechanism according to the invention can be outfitted with previously used swivel lever actuating mechanisms without electrical locking in that, for example, this constructional unit can be used in conventional actuating levers, possibly with slight machining if necessary. On the other hand, it is possible to convert previous swivel lever actuating mechanisms simply by exchanging with the version according to the invention.

Due to the electrical locking, cylinders with associated cylinder locks which were previously used in the prior art can be dispensed with. This is advantageous in that a key which was previously necessary is necessary no longer and therefore can not be lost or fall into the wrong hands.

In a particularly advantageous further development, the handle has an opening on its upper side in the area of the constructional unit, through which opening the constructional unit inserted in the dish is accessible when the actuation lever is swiveled in. This has the advantage that there is no need to provide an electrical connection to the actuation lever, so that the design is simplified and can be made more reliable in operation.

In particular, flexible lines and plug-in contact constructions which are very susceptible to malfunction are dispensed with.

There is a variety of possibilities for the constructional unit. In a particularly favorable embodiment form, the opening has the size and shape of a fingerprint and the accessible surface of the constructional unit has a fingerprint sensor surface (also called a biometric sensor device). With this construction, it is possible to analyze the fingerprint lines of a user's thumb which is placed upon the opening of the actuation lever and accordingly contacts the fingerprint sensor surface of the constructional unit by means of suitable electronic devices inside the constructional unit in order to determine whether or not the person to whom the fingerprint belongs is authorized to access the switch cabinet. If so, the constructional unit can respond in such a way that it emits a control signal for driving its projection or pin and swiveling it or moving it in so as to open the lock, whereupon the user can swivel out the actuation lever and can open the closure.

Another possibility consists in that the opening in the actuation lever is constructed in such a way that light (visible or not) can pass through and in that an optical sensor surface is arranged on the surface of the constructional unit that is accessible to the light, which optical sensor surface responds to the light signal in a determined manner insofar as the light is modulated (has a pattern) in time or space such that it can represent a characteristic which signals the electromechanical lock device arranged downstream of the sensor surface that the signal pattern generated by the light pertains to a user who is authorized to open the switch cabinet or the like.

As another alternative, a keyboard which is accessible through the opening is arranged on the constructional unit. The keyboard can then be actuated, for example, by means of a simple pin or with the tip of a finger and, e.g., a coded message can be entered to unlock the lock device.

In another alternative, a key actuation arranged in the constructional unit is accessed through the opening. The key actuation can have the form of the previous cylinder key arrangement, but in this case is mounted in the constructional unit supported by the dish rather than in the handle as in the prior art. The actuation lever is accordingly narrower and easier to handle.

By means of the key, it is possible to trigger a pulse or otherwise generate a signal which leads to the lock device being electrically unlocked in the manner described above.

When a transponder device is installed in the constructional unit, it may even be possible to dispense with the opening in the hand lever, since the electromagnetic wave by which the transponder device can be actuated can easily penetrate the material of a hand lever when this material comprises plastic, for instance.

The transponder device has the further advantage that it can receive energy from the external device, e.g., in order to initiate the opening process by means of this energy without the need for battery devices, for example.

Another possibility for dispensing with batteries or for simplifying the charging of batteries is achieved in that a photovoltaic arrangement is provided in the area of the opening on the constructional unit, this opening making this device accessible to the external light.

In order to facilitate the detection processes, particularly at higher levels of security, it is advantageous when the constructional unit comprises a microprocessor chip that can carry out sufficiently complicated calculating processes to enable high degrees of security, e.g., when entering codes or scanning fingerprints.

The chip has the further advantage that a design is made possible in which the entire arrangement communicates with a network, e.g., with an internal network, which reports the state of the closure to a remote control terminal. Conversely, it may also be possible to unlock the closure from the remote control terminal, e.g., in case of emergency or the like.

An interface of this kind for connecting to a data network or the like can be carried out by wiring or advantageously by means of a wireless connection, e.g., by means of an infrared interface to which a mobile telephone provided with a corresponding complementary interface can be connected, for example.

According to another further development of the invention, the control lever can have a displaceable or swivelable cover on its upper side for the opening. Therefore, it is possible to protect the device arranged under this opening, e.g., a sensor device, from damage and soiling.

It has turned out to be particularly favorable mechanically when the constructional unit comprises a cup-shaped housing whose bottom has a receiving space for sensor devices or the like which can be accessed through the opening in the hand lever, this receiving space being accessible from the outside. When the constructional unit comprises a cup-shaped housing, it is advantageous when the side wall of the housing has an opening for the lock pin or lock projection to pass through. A constructional unit with a cup-shaped housing of the type mentioned above preferably has a flange-like edge having bore holes for clamping screws to pass through, by means of which clamping screws the cup (together with a cover, for example) can be accommodated and fixed in a corresponding recessed area of the dish. The fastening screws could serve at the same time to clamp the dish inside a door leaf or the like.

It has proven advisable when the constructional unit comprises an electric motor drive unit which moves the lock pin or lock projection alternately in or out when controlled. For example, an actuation pulse can cause the lock pin or lock projection to move out and lock the swiveled in lever in the dish, while a repeated pulse causes the pin or projection to move in and thus release the actuation lever.

This type of actuation of the lock pin or lock projection is particularly reliable and saves power.

The microprocessor can also be used for switching off power-consuming circuit areas after a determined quiescent time. As soon as a trigger signal of some kind arrives from the sensor surface, the microprocessor switches the power supply on again momentarily. This preserves an accumulator or battery (rechargeable energy storage) that may be provided in the device.

In order to switch on, for example, a sliding cover or the like is pushed back so that light strikes the sensor surface, for example. Alternatively, the slide itself can also have a contact which, when actuated, supplies a pulse to the microelectronics device in order to put this device into operation.

This makes it possible to operate the arrangement for months without maintenance, i.e., long operating periods can be covered with a battery or accumulator charge.

The swivel lever actuating mechanism according to the invention can be used in a wide variety of closures, for example, in sash closures, bar closures, etc.

In the following, the invention will be explained more fully with reference to embodiment examples shown in the drawings.

DESCRIPTION OF THE PREFERRED EMBODIMENTS

Figure 1A:
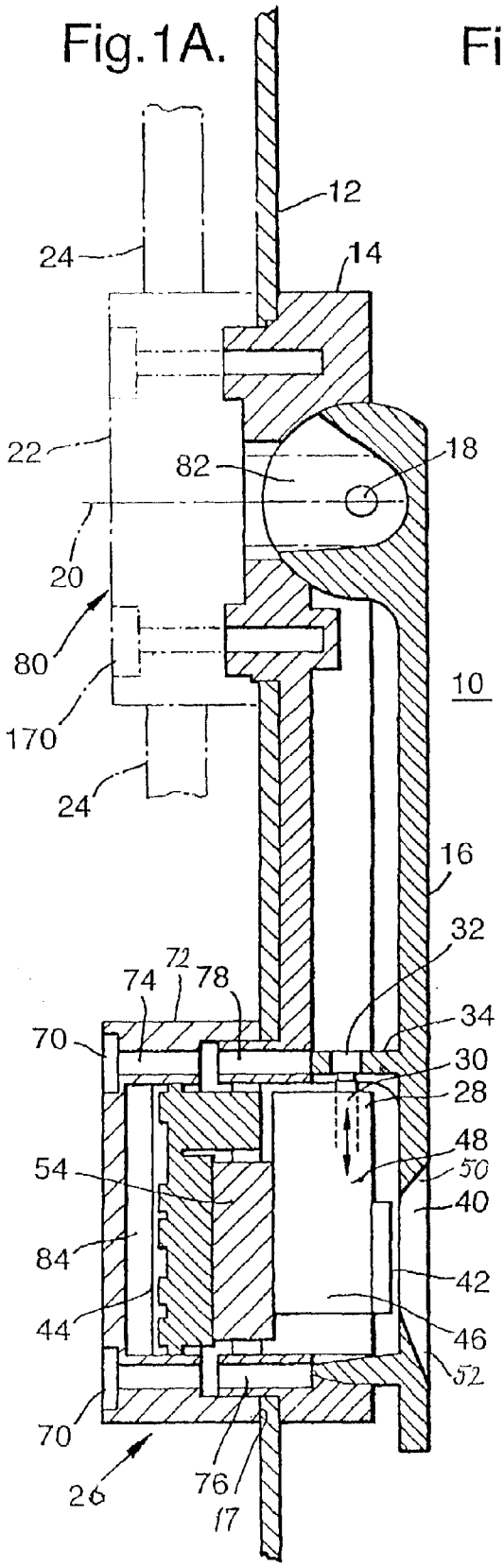
FIG. 1A shows a longitudinal section through a swivel lever actuating mechanism, according to the invention, in connection with a thin wall.

FIG. 1A shows an electrically lockable swivel lever actuating mechanism 10 comprising a dish 14 which can be placed on a door leaf 12 or the like. An actuation lever 16 is mounted in the dish 14 in such a way that from a position in which it is swiveled out of the dish (see swivel-out axis 18) and in which actuation of the closure actuation is made possible, e.g., by rotating the swiveled out hand lever 16 about the axis 20, e.g., of a ribbon bar lock casing 22, during which rotation, for example, ribbon bars 24 mounted in the lock casing 22 are pushed outward, a door leaf in a frame, for example, is unlocked in a manner known per se (see prior art) during this pushing outward. Conversely, when the actuation lever 16 is in the swiveled in position shown in FIG. 1A, actuation of the closure is not possible. An electromechanical lock device which holds the swivel lever 16 in its swiveled in position serves to secure the hand lever and, therefore, the closure in this position.

Figure 3:
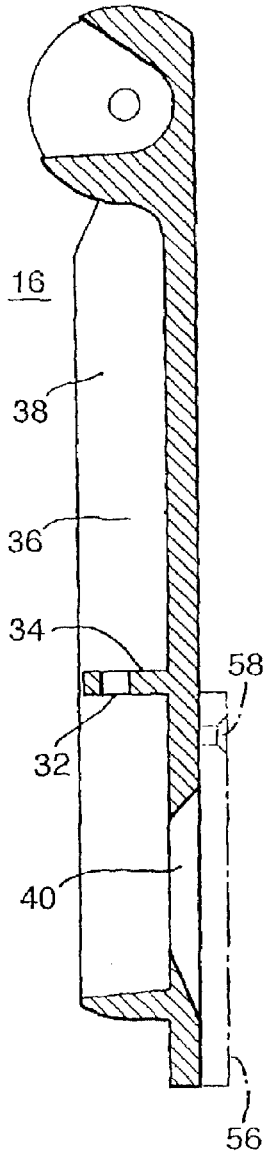
FIG. 3 is a sectional view through the actuation lever according to FIG. 1A.
Figure 4:
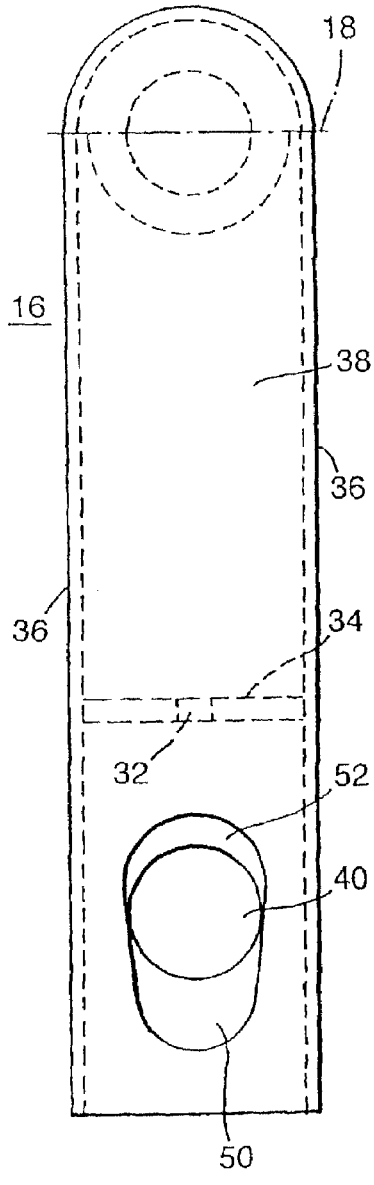
FIG. 4 shows a top view of the actuation lever according to FIG. 3.

According to the invention, the electromechanical lock device 10 comprises a constructional unit 26 which can be inserted into the dish 14; a pin or projection 28 of the constructional unit 26 can be moved out or swiveled out to lock the actuation lever 16 by means of an electric adjusting signal. When the pin 28 moves out in the direction indicated by the arrow 30, the pin 28 penetrates a bore hole 32 which is formed by a shoulder or intermediate wall 34 formed by the bottom forming a trough and by side walls 36 of the actuation lever 16 (see FIG. 3). The pin accordingly holds the actuation lever 16 in its swiveled in position when it is moved out. As also follows from FIGS. 3 and 4 (see also FIG. 1A), the actuation lever 16 has, on its upper side, an opening 40 in the area of the constructional unit 26, which opening 40 is formed by the bottom wall of the trough-shaped section 38. When the actuation lever is swiveled out as shown in FIG. 1A, the constructional unit 26 inserted into the dish 14 is accessible through this opening 40. The embodiment form represented in the drawings shows an opening 40 which is so constructed with respect to size and shape that a thumb or finger can be comfortably accommodated in such a way that most of the fingertip or thumb rests on the surface 42 of the constructional unit 26 that is accessible below the opening 40. In this case, this surface 42 is a so-called biometric sensor surface which can detected fingerprint lines which differ from one individual to the other, and a corresponding image signal is processed at a processing device such as a microprocessor chip 44 and compared to a comparison pattern that is entered, so that when there is a match a control pulse or a control signal is generated which controls an electric linear drive 46 which then pulls back the pin 28, for example, from the locked position in the direction of the arrow 48 and accordingly releases the actuation lever 16 for swinging around the shaft 18. The opening 40 in the actuation lever 16 is shaped like the tip of a thumb or index finger and is beveled 50, 52 so as to be adapted to the latter, so that the surface of the fingertip is not distorted unnecessarily when the thumb is pressed into the opening 40, so that the fingerprint lines are detected with greater accuracy.

The lock opening 32 is advantageously enclosed on all sides so as to impede tampering with the lock device by unauthorized persons.

Instead of a biometric sensor device such as that described above, an alternative embodiment form in which, for example, the surface 42 located below the opening 40 is an optical sensor surface is also conceivable. When this surface is irradiated by light with a determined spatial variation or pattern (spatially modulated light) or pulsed light in a determined code (temporally modulated light), a sensor output signal can be generated and suitably processed for opening the lock device. With pulsed light, there are no scattering influences so that the opening 40 could then also be closed by glass or Plexiglas which is opalescent rather than transparent; when the light is radiated in a spatially modulated manner, it is important that a protective wall of the type mentioned above is transparent so that this spatial distribution of the light is imaged on the sensor surface without being influenced by scattering.

The surface 42 could also have a keyboard, for example, a keyboard with four keys which would make it possible to enter encoded data by pressing on these keys, e.g., by a pin or by a fingertip when the individual keys are sufficiently large.

Standard key operation is also conceivable, although it is disadvantageous to have a key which could be lost; moreover, standard key operation involves a cylinder, for instance, which takes up a relatively large amount of space.

The surface 42 can also be a so-called transponder having a coil which receives energy from a second coil which is guided past in the vicinity of the actuation lever 16 in order to provide the linear motor 28, for example, with energy for displacing the pin 30 and in order at the same time also to transmit digital information indicating, for example, whether or not the transponder device is carried by an authorized user outside of the actuation lever 16. A transponder device has the advantage that it can also write information into the memory chip of the microprocessor device of the swivel lever actuating mechanism, for example, in order to change the authorization code and to read off actuating times and actuating frequencies and subsequently read them out and process them in a data processing device.

The clock time and date on which the switch cabinet is opened could be recorded, for example.

Figure 6:
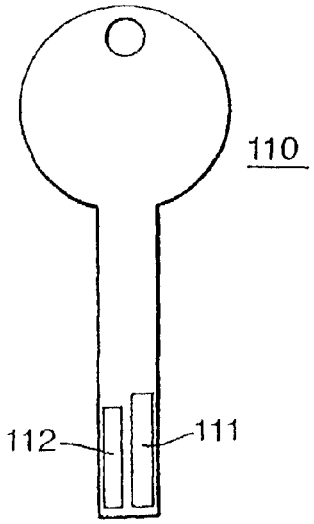
FIG. 6 shows a key for transponder operation.

A transponder 111 of the type mentioned above can also be built into a key 110 as is shown in FIG. 6 by key 110 which is injection molded, e.g., from plastic.

It is particularly advantageous when the key also has a magnet 112 in addition to the transponder 111.

The key 110 could then cooperate with the electrically lockable swivel lever actuating mechanism in such a way that when the key 110 approaches the swivel lever actuating mechanism the magnet 112' arranged at the key 110 switches on the power supply for this swivel lever actuating mechanism (e.g., by means of a reed contact accommodated in the swivel lever actuating mechanism).

In particular, the key could cooperate with a contact that can be triggered by a magnetic field, such as a reed contact located in a transponder reading device arranged in the electrically lockable swivel lever actuating mechanism, such that the contact switches on the power supply, at least the power supply of the reading device, when the magnet approaches.

Instead of supplying energy to the circuit and motor drive unit or accumulator by means of a transponder, this can also be carried out by means of a photovoltaic device insofar as the opening 40 makes a photovoltaic device arranged on the constructional unit accessible to external light so that this device which comprises photodiodes, for example, can generate energy based on the incident light.

Another alternative for the power supply is the arrangement of an accumulator 54 or an exchangeable battery.

In order to protect the sensor surface 42 against soiling and damage, it may be advantageous, depending on the application, to provide a displaceable or swivelable cover for the opening 40 on the upper side of the actuation lever, this cover 56 being swivelable about an axis 58 or displaceable along the lever axis, for example.

Figure 1B:
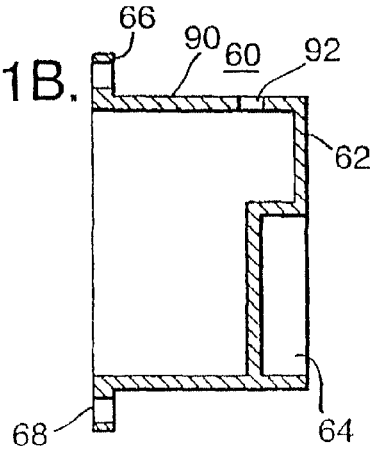
FIG. 1B is a sectional view showing the cup, according to the invention, for the constructional unit.
Figure 1C:
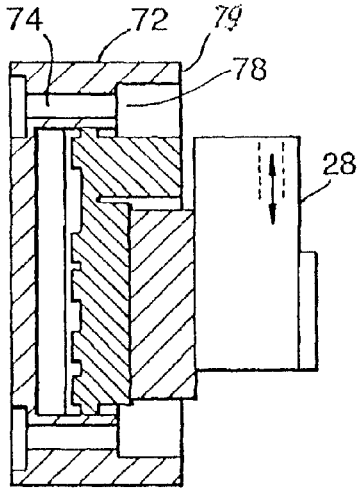
FIG. 1C shows the units to be introduced into the cup such as the drive unit, battery and microprocessor device and, finally, the cover cap for the entire arrangement.
Figure 2:
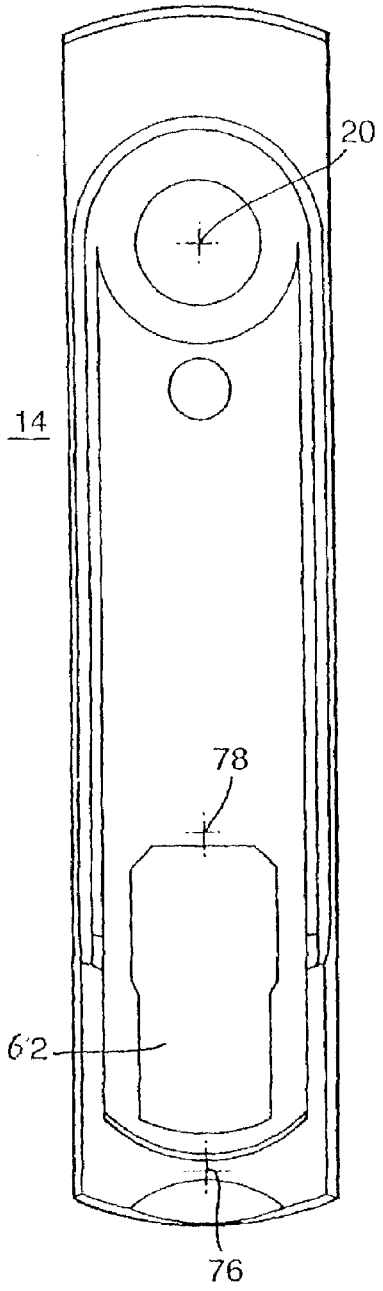
FIG. 2 shows a top view of the dish of the arrangement according to FIG. 1A.

As can be seen in FIG. 1B, the constructional unit comprises a cup-shaped housing 60 whose base 62 has a receiving space 64 for sensor devices 42 or the like which are accessible through the opening 40 in the hand lever 16, this receiving space 64 being accessible from the outside. Further, the housing 60 has a flange-like edge 66 having bore holes 68 through which fastening screws or clamping screws 70 can be guided. After it is inserted into a corresponding receiving space 62 of the dish 14 (see FIG. 2), the housing 60 can be secured by these fastening or clamping screws 70 in that, after a cover 72 with corresponding bore holes 74 is placed on top, cap screws can be inserted through these bore holes 74, 68 and through bore holes 78, 76, which cap screws press the cup by its annular shoulder 77 on the flange 66 of the cup 60 on the one hand, and the door leaf is clamped in between the latter and the dish 14 by an edge 79 on the other hand, so that the entire arrangement is secured in a clamping manner in this location. FIG. 1A shows by dashed lines that the other end of the dish 14 can also be similarly fastened in a clamping manner in that a lock casing or gear housing 80 is provided in such a way that the thin wall 12 is clamped between the dish 14 and the casing 80 by means of screws 170. Also shown in dashes are lock bars 23 projecting from the casing 80 and a lock drive shaft 82 which is corrected on one side to a pinion, not shown, arranged inside the housing 80 and on the other side at its free end to the swivel lever 16 by means of the pin shaft 18.

In this connection, reference is also had to the construction according to the prior art.

Figure 5:
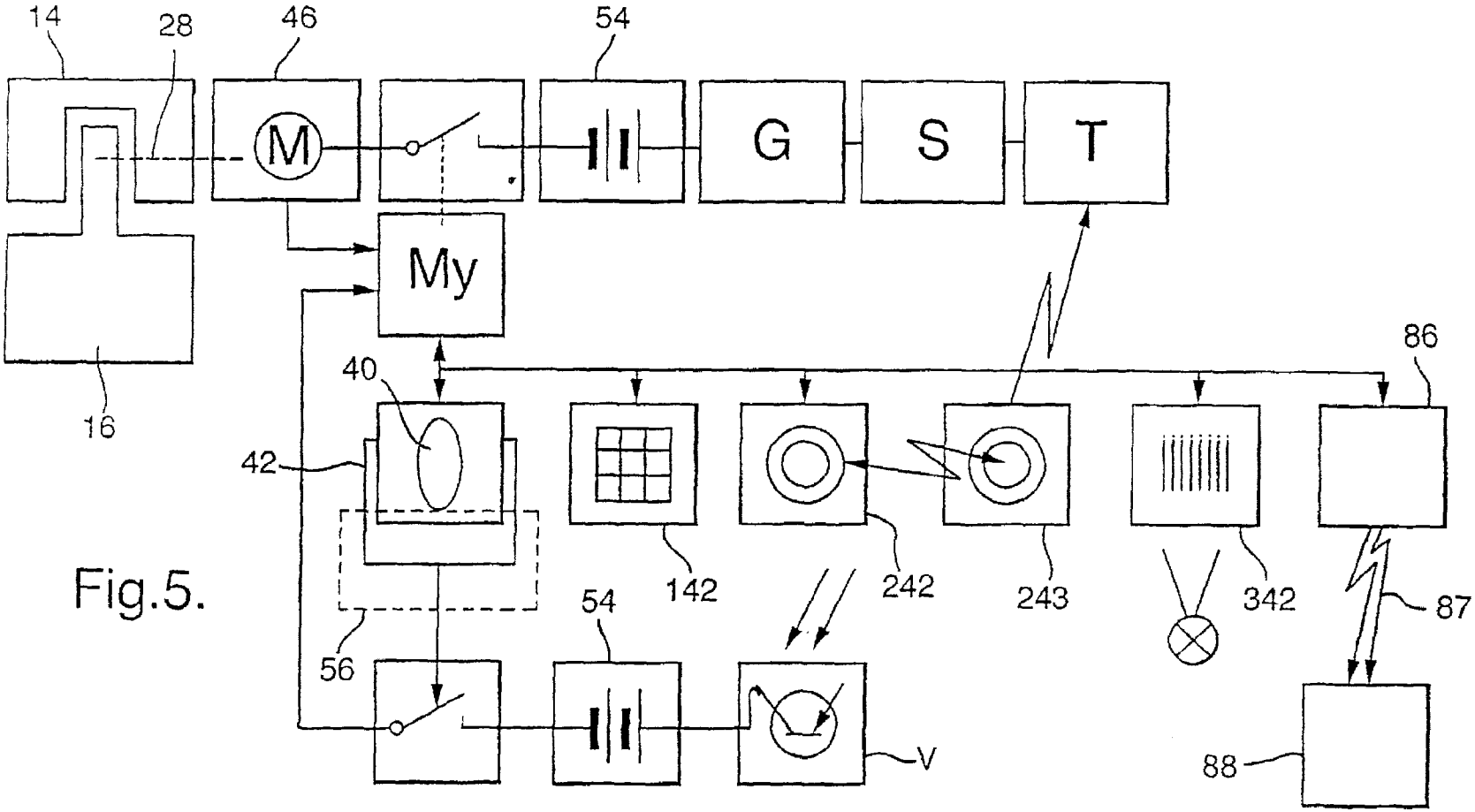
FIG. 5 shows a block wiring diagram to illustrate the function of the swivel lever actuating mechanism according to the invention.

The cover 72 also encloses an electronic lock of the housing 84 which ensures that the housing can not be dismantled without being noticed and documented. FIG. 5 shows a flow chart for the operation of the swivel lever actuating mechanism according to the invention. The block diagram shows the actuation lever 16 which is secured within the dish 14 by a pin 28 when the linear drive 46 has pushed it into the locking position. The position of the motor or drive unit can be checked by a microprocessor MY which also connects the drive 46 unit to a battery 54 in order to supply it with a pulsed current. If the battery 54 is an accumulator, it could be charged by a generator G or ,alternatively, a photovoltaic device S or transponder device T. The microprocessor MY is controlled, for example, by the biometric sensor device 42 which supplies signals that are triggered by the thumb through the opening 40 and which can be covered by a protective cover device 56. By sliding open or opening the protective cover device 56 to release the opening 40, a switch may be actuated which can initiate the start of operation of the entire arrangement. Alternatively, a keyboard or keypad device 142 which is shown in the present case with nine keys can be connected with the microprocessor MY; also shown is a transponder device 242 controlled by an external transceiver 243.

The drawing also shows the generation of electrical energy for charging a battery 54 by means of a photovoltaic device V. Also shown is an optical sensor device 342 and an interface 86 which works either by means of plug-in devices or preferably by means of infrared connection 87 in order to enter into a connection with a network device 88, e.g., a mobile telephone network.

Commercial Applicability

The invention is commercially applicable in switch cabinet engineering.

While the foregoing description and drawings represent the present invention, it will be obvious to those skilled in the art that various changes may be made therein without departing from the true spirit and scope of the present invention.

What is claimed is:

1. An electrically lockable swivel lever actuating mechanism comprising:

a dish which can be placed on a door leaf and in which an actuation lever for a closure is mounted wherein the actuation lever is structured to be swiveled out of the dish to unlock the lockable swivel lever actuating mechanism and also is structured to be swiveled into the dish to lock the lockable swivel lever actuating mechanism at a position wherein the actuation lever does not allow actuation of the closure and in which the actuation lever can be further locked by an electromechanical lock device;

said electromechanical lock device being a constructional unit which can be inserted into the dish;

wherein a pin or projection is provided and is capable of being moved out or swiveled out from the constructional unit by an electric control signal for further locking the actuation lever; and said actuation lever having an opening on its upper side in the area of the constructional unit, through which opening the constructional unit inserted in the dish is accessible when the actuation lever is swiveled in.

2. The electrically lockable swivel lever actuating mechanism according to claim 1, wherein the opening has the size and shape of a fingerprint, and the accessible surface of the constructional unit has a fingerprint sensor surface.

3. The electrically lockable swivel lever actuating mechanism according to claim 1, wherein the opening allows light to pass through without scattering, and the surface of the constructional unit that is accessible to the light has an optical sensor surface.

4. The electrically lockable swivel lever actuating mechanism according to claim 1, wherein the opening affords access to a keyboard that is arranged on the constructional unit.

5. The electrically lockable swivel lever actuating mechanism according to claim 1, wherein the opening affords access to a key actuation device arranged on the constructional unit.

6. The electrically lockable swivel lever actuating mechanism according to claim 1, wherein the opening affords access to a transponder device arranged on the constructional unit.

7. The electrically lockable swivel lever actuating mechanism according to claim 1, wherein the opening affords access to a light-sensitive element arranged on the constructional unit.

8. The electrically lockable swivel lever actuating mechanism according to claim 1, wherein the constructional unit comprises a microprocessor chip.

9. The electrically lockable swivel lever actuating mechanism according to claim 1, wherein the constructional unit comprises an energy accumulator for electrical energy.

10. The electrically lockable swivel lever actuating mechanism according to claim 9, wherein the energy accumulator or other energy-consuming devices are supplied by a photovoltaic cell.

11. The electrically lockable swivel lever actuating mechanism according to claim 1, wherein an electrical energy is supplied by a transponder.

12. The electrically lockable swivel lever actuating mechanism according to claim 1, wherein the constructional unit communicates with or has an interface for connecting to a data network.

13. The electrically lockable swivel lever actuating mechanism according to claim 1, wherein the actuation lever has a displaceable or swivelable cover on its upper side for the opening.

14. The electrically lockable swivel lever actuating mechanism according to claim 1, wherein the constructional unit comprises a cup-shaped housing whose side wall has an opening for the passage of the lock pin or lock projection.

15. The electrically lockable swivel lever actuating mechanism according to claim 1, wherein the constructional unit comprises an electric motor drive unit which moves the lock pin or lock projection alternately out or in when controlled.

16. The electrically lockable swivel lever actuating mechanism according to claim 1, wherein the constructional unit is held by a cover, the wall, which carries the swivel lever actuating mechanism being simultaneously clamped by the cover between itself and the dish.

17. A method of using the electrically lockable swivel lever actuating mechanism according to claim 1, comprising the steps of using said mechanism in a bar closure, sash closure or bolt closure.

* * * * *